United States Patent [19]

Mehta

[11] 4,246,853

[45] Jan. 27, 1981

[54] FUEL FIRING METHOD

[75] Inventor: Arun K. Mehta, East Granby, Conn.

[73] Assignee: Combustion Engineering, Inc., Windsor, Conn.

[21] Appl. No.: 70,219

[22] Filed: Aug. 27, 1979

[51] Int. Cl.[3] ..... F23K 1/00; F23D 1/00

[52] U.S. Cl. ..... 110/347; 110/263; 110/261; 110/344

[58] Field of Search ..... 110/344, 347, 348, 204, 110/261, 263, 265

[56] References Cited

U.S. PATENT DOCUMENTS

| | | | |
|---|---|---|---|
| 1,756,321 | 4/1930 | Cross | 110/264 |
| 1,819,174 | 8/1931 | Jacobus | 110/261 |
| 1,954,351 | 4/1934 | Dornbrook et al. | 110/347 |
| 2,259,967 | 10/1941 | Vogel-Jorgensen | 110/263 |
| 2,293,736 | 8/1942 | Heller | 110/265 |
| 2,511,587 | 6/1950 | Jackson | 110/347 |
| 3,048,131 | 8/1962 | Handgrove | 110/344 |
| 3,246,635 | 4/1966 | Powell | 122/479 |
| 3,688,747 | 9/1972 | Connell | 122/333 |
| 4,060,376 | 11/1977 | Peredi | 431/10 |
| 4,150,631 | 4/1979 | Frey et al. | 110/186 |

*Primary Examiner*—Henry C. Yuen

*Attorney, Agent, or Firm*—Edward L. Kochey, Jr.

[57] ABSTRACT

A method of operating a pulverized coal furnace wherein the coal is introduced with minimal oxygen through an intermediate zone of the furnace which also has a relatively low oxygen content. The carbon particles are projected into an upstream portion of the furnace where secondary air is introduced to burn the carbon particles. The combustion products pass upwardly through the intermediate zone to a downstream zone where tertiary air is added to complete combustion.

7 Claims, 3 Drawing Figures

FUEL FIRING METHOD

BACKGROUND OF THE INVENTION

This invention relates to burning of pulverized coal in a furnace and in particular to a method of introducing fuel and air into the furnace.

Pulverized coal has been introduced in the furnaces for combustion in many different ways including tangential introduction into a furnace with flow upwardly or downwardly therefrom, and vertical firing from the top of the furnace with a reversal of the combustion gases in the furnace and exit through the top of the furnace. Air also has been added to the furnace to support combustion in a plurality of ways. In most cases the air has been supplied in an effort to burn the fuel to the fullest extent possible immediately. In other cases, staged combustion has been used wherein a deficiency of air is supplied with the coal in order to restrict the initial combustion rate.

Oxides of nitrogen, conventionally termed $NO_x$, are objectionable atmospheric pollutants which occur in combustion products. Two sources of $NO_x$ have been identified. Nitrogen in the air breaks down at high temperature and tends to recombine with oxygen. Nitrogen in the fuel is released even with combustion at lower temperatures, and this also combines with oxygen in the air. The invention relates to its effectiveness in the reduction of the $NO_x$ due to nitrogen in the fuel. By restricting the initial combustion rate and inherently cooling the flame by the furnace walls, the time of combustion is delayed and lower maximum combustion temperatures are achieved. This reduces the formation of oxides of nitrogen which are due to the nitrogen contained in the air.

It does not, however, appear to have a significant effect on the oxides of nitrogen which are formed because of the nitrogen in the fuel.

In the prior art combustion processes the procedure was such that the volatiles which were driven off from the coal by the initial heating continued to flow with the coal. Therefore, as the newly introduced coal mixed with oxygen the volatiles would tend to be the first ones burned. The remaining carbon particles which are more difficult to burn must be oxidized in air which is already partially depleted of oxygen.

SUMMARY OF THE INVENTION

It is an object of the invention to increase the effectiveness of the burning of the carbon particles of the coal. It is a further object of the invention to decrease the oxides of nitrogen formed in the combustion of fuel.

Coal is introduced with a minimum of oxygen, limited to that which is required to convey the coal, as a high momentum stream through an intermediate zone of the furnace. This intermediate zone contains a relatively reducing atmosphere. The coal in passing through this atmosphere is exposed to the high radiant heat from other areas of the furnace. Volatile components of the coal are, therefore, driven off. While the relatively heavy char particles continue to the upstream zone of the furnace, the volatiles which are released are stripped from the stream by friction with the surrounding atmosphere and tend to remain in the intermediate zone. Conversion to $NO_x$ of fuel nitrogen released with the volatiles would be minimal, due to the reducing conditions.

From this zone the volatiles and products formed therefrom pass to a downstream zone. The char particles which have continued to the upstream zone are therein mixed with fresh secondary air which is tangentially introduced into this zone. In this manner, the char particles are contacted by air which contains a maximum oxygen content, since the oxygen has not been depleted by reaction with the volatiles from the coal. Some of the nitrogen still contained in the char will be converted to $NO_x$.

Thereafter the combustion products from the upstream zone pass through the intermediate zone and continue to a downstream zone wherein tertiary air is added to complete combustion of the char particles and the volatiles which have been stripped in the intermediate zone. Any $NO_x$ formed in the upstream zone will be partially reduced in passing through the intermediate zone.

While described with respect to coal firing, the invention is also efficacious when firing other fuels, such as shredded refuse, oil, etc.

DESCRIPTION OF THE PREFERRED EMBODIMENTS

A furnace indicated generally as 10 includes an intermediate zone 12, an upstream zone 14 and a downstream zone 16. A duct 18 carries the combustion products from the furnace.

Figure 2:
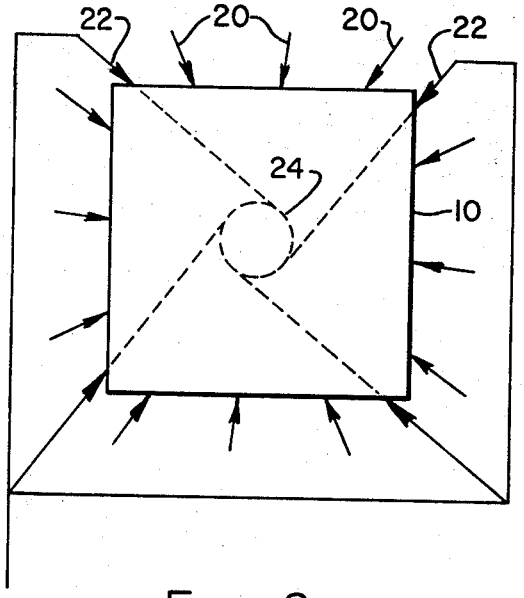
FIG. 2 is a plan view taken through section 2—2 of FIG. 1 illustrating the direction of introduction of secondary air and fuel.

Pulverized coal which may be supplied either from a bin system or directly fired from a pulverizer is supplied through coal nozzles 20. The coal is introduced with high momentum in a direction such that the coal particles pass through the intermediate zone 12 into the upstream zone 14. As best seen in FIG. 2, these nozzles are preferably directed toward the vertical axis of the furnace. Since a vortex action is set up in the furnace by introduction of air to be described hereinafter there is less resistance to the downward flow of coal in the center portion of the furnace and better penetration may be achieved by directing the coal nozzles to this location. It also improves the passage of gas upwardly through the same area as the incoming fuel.

In this intermediate zone 12 the coal stream is exposed to radiation from the remainder of the furnace and the volatile components of the coal are driven off. These components being gaseous will be stripped from the stream by friction with the surrounding environment and will, therefore, not proceed to the lower portion 14 of the furnace. Since the amount of oxygen in the intermediate zone 12 is restricted, these volatiles will not burn to completion at this time and accordingly will create a reducing atmosphere in this zone.

Since the oxygen supply in this zone is low, the volatile matter including the nitrogen will tend to not oxidize at this point. This provides time for the nitrogen driven out of the fuel to form molecular nitrogen before it reaches the downstream zone 16 where additional air is introduced to complete the combustion.

In the upstream zone 14 the major portion of air is supplied as secondary air through nozzles 22. The orientation of these nozzles is such as to direct the flow to an imaginary circle 24 within the furnace thereby imparting a tangential action to the gases and effecting a scrubbing action between the char particles and the incoming air. The devolatilized char particles which are existing in the upstream zone 14 are the most difficult to burn. In this invention these particles contact the incoming air directly which has the maximum oxygen content, thereby increasing the effectiveness of burning these char particles.

This air is supplied by forced draft fan 26 and conveyed through ducts 28. Regulating damper 30 may be used to control the amount of air introduced through nozzles 22.

Air from fan 26 may also be introduced through lines 34 with the flow regulated from damper 36 if primary air is to be used for transportation of the coal into the furnace. Air from fan 26 is also used to supply tertiary air through nozzles 38 in an amount controlled by dampers 40 as tertiary air.

The turbulent mixing between the char particles in the upstream zone 14 and the incoming air should be effective to burn most of the carbon present. The combustion products from this zone continue with a cyclonic action passing upwardly through the intermediate zone 12 in the same areas as the passage of fuel. These gases should contain little or no oxygen since extensive combustion of the coal particles has occurred in the lower portion of the furnace.

The gases then continue upwardly into the downstream zone 16 along with volatile components and products thereof which has been driven off from the fuel in the intermediate zone 12. Tertiary air is added through nozzles 38 in a manner to mix the air with the combustion products and to thereby permit final burning of the remaining char particles and the volatiles.

Figure 1:
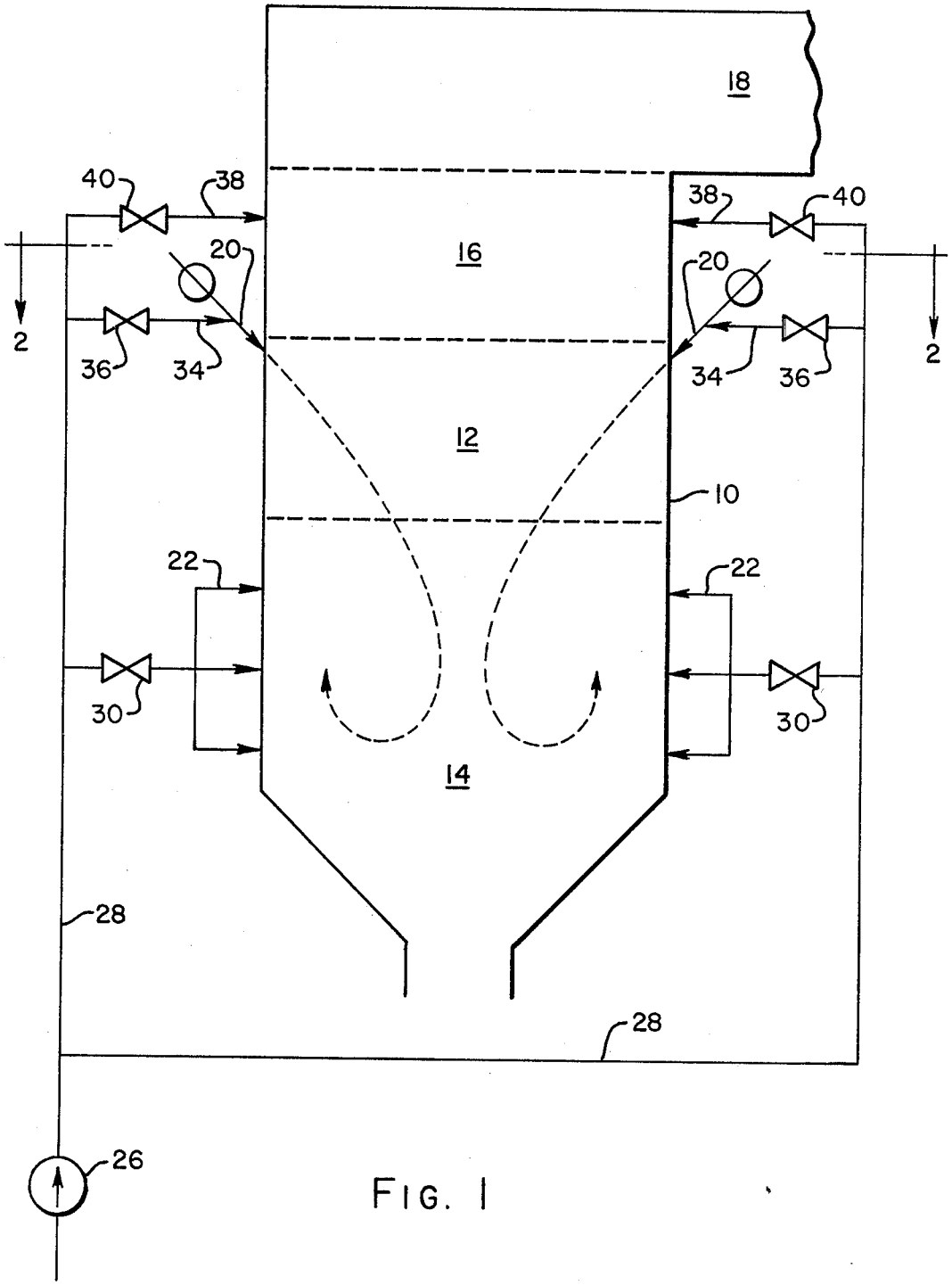
FIG. 1 is a schematic illustration of a furnace wherein the coal is introduced with primary air.
Figure 3:
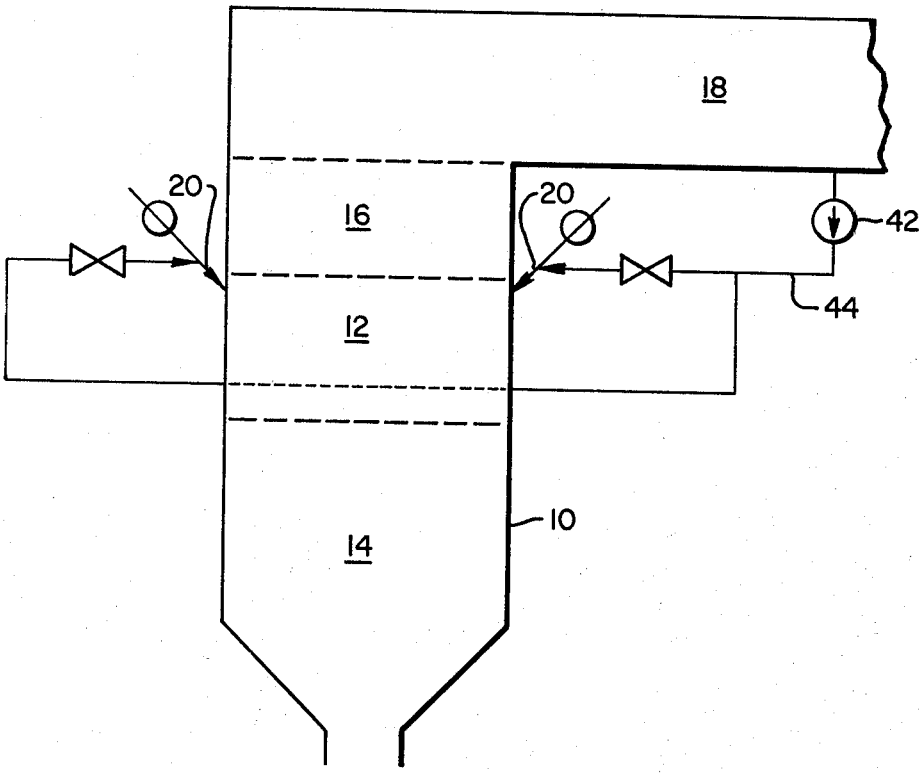
FIG. 3 is a schematic arrangement of a furnace wherein combustion products are used to convey the coal to the furnace.

Referring now to FIG. 3, the operation is identical with that of FIG. 1 with the exception of the coal conveying medium. Gas fan 42 withdraws a portion of the products of combustion from duct 18 and passes then through line 44. As schematically illustrated the withdrawn portion of gas passes through the coal nozzle 20 as the conveying medium for the coal to effect high velocity injection of the coal into the furnace. While illustrated as joining the nozzle near the furnace, it is to be understood that the gas could pass through a pulverizer and carry the coal particles from that location or could alternately be used to convey coal from a bin storage system.

Since the flue gas inherently has a very low oxygen content, the use of this gas for transporting the coal provides a stream with very little oxygen therein. This avoids the burning of the volatiles due to oxygen in the primary air. For a given air fuel ratio on a boiler this increases the availability of oxygen to the upstream furnace zone 14 with the volatiles depending on the tertiary air for combustion as previously described.

Fuels other than coal may be fired, according to the invention, with the same principle being followed, and the same advantages accruing. Oxides of nitrogen are reduced since the nitrogen in the fuel is driven off in the presence of a substantially oxygen-deficient atmosphere, and the combustion process is improved since an increased air-rich atmosphere is provided in the upstream zone 14 where the difficult-to-burn fuel particles are oxidized.

What is claimed is:

1. A method of firing a nitrogen bearing fuel in a furnace having an upstream zone, an intermediate zone, and a downstream zone, comprising: introducing fuel into said furnace with a minimal amount of oxygen through said intermediate zone in a direction and at a velocity to carry the fuel particles into said upstream zone; introducing secondary air tangentially into said upstream zone, and burning most of the fuel therein, thereby forming combustion products; passing a major portion of the combustion products formed in said upstream zone through said intermediate zone, in the same areas as the passage of fuel therethru, to said downstream zone; and introducing tertiary air into said downstream zone to complete the burning of fuel, whereby fuel nitrogen is volatized in a hot oxygen deficient atmosphere, thus favoring the formation of diatomic nitrogen.

2. A method as in claim 1 wherein said fuel is a solid.

3. A method as in claim 2 wherein said fuel is pulverized coal.

4. A method as in claim 3 wherein said pulverized coal is introduced with a minimal amount of primary air.

5. A method as in claim 4 including also withdrawing a portion of the combustion products from the combustion product stream at a location downstream of said furnace; and using said withdrawn portion of combustion gases as the conveying medium to introduce the pulverized coal into said furnace.

6. A method as in claim 5 wherein said introduction of pulverized coal is in a direction such that the char particles remaining after devolatilization enters said upstream zone near the axis of said furnace.

7. A method as in claim 1, 5 or 6 including introducing fuel from locations substantially around the periphery of said furnace.

* * * * *